US006167807B1

(12) United States Patent
Maggio

(10) Patent No.: US 6,167,807 B1
(45) Date of Patent: Jan. 2, 2001

(54) HAND SHAPED FLUID MEDIUM CONTAINING ARTICLE FOR USE IN TRANSFERRING IMAGES

(76) Inventor: Michael Maggio, 275 Henley Rd., Wynnewood, PA (US) 19096

( * ) Notice: Under 35 U.S.C. 154(b), the term of this patent shall be extended for 0 days.

(21) Appl. No.: 09/199,368

(22) Filed: Nov. 25, 1998

(51) Int. Cl.[7] ..... B41K 1/54
(52) U.S. Cl. ..... 101/333; D18/17
(58) Field of Search ..... 101/327, 333; D18/14, 15, 17; 446/390, 146; D9/311, 314; 434/103, 98, 84

(56) References Cited

U.S. PATENT DOCUMENTS

| | | | | |
|---|---|---|---|---|
| D. 163,496 | | 5/1951 | Prooyen, Jr. | D18/17 |
| D. 219,075 | | 10/1970 | Majewski | D18/17 |
| D. 247,063 | | 1/1978 | Funahashi | D18/17 |
| D. 318,289 | | 7/1991 | Halm | D18/17 |
| D. 353,392 | | 12/1994 | Winston | D18/15 |
| D. 382,581 | | 8/1997 | Yasoshima | D18/17 |
| D. 424,605 | * | 5/2000 | Rupa | D18/16 |
| 1,073,036 | * | 9/1913 | Fuchs | 101/333 |
| 2,684,012 | * | 7/1954 | Hebert | 88/16 |
| 2,835,196 | * | 5/1958 | Herbert et al. | 101/333 |
| 3,326,180 | * | 6/1967 | Lofgren | 101/333 |
| 3,817,178 | * | 6/1974 | Hagen | 101/327 |
| 4,537,128 | | 8/1985 | Burroughs et al. | 101/327 |
| 4,593,427 | * | 6/1986 | Ortolivo | 15/227 |
| 5,165,337 | * | 11/1992 | Schlundt | 101/127 |
| 5,431,098 | * | 7/1995 | Winston | 101/211 |
| 5,531,829 | * | 7/1996 | Yasoshima | 101/333 |
| 5,636,569 | * | 6/1997 | Winston | 101/333 |
| 5,743,185 | * | 4/1998 | Hippely et al. | 101/327 |
| 5,980,351 | * | 11/1999 | McCook | 101/327 |

* cited by examiner

*Primary Examiner*—John S. Hilten
*Assistant Examiner*—Leslie J. Grohusky
(74) *Attorney, Agent, or Firm*—Akin, Gump, Strauss, Hauer & Feld, L.L.P.

(57) ABSTRACT

A fluid medium containing article for use in transferring an image onto a second article is provided. The fluid medium containing article includes a base and a fluid medium retaining pad positioned on the base. The base is generally in the shape of a terminal portion of a human extremity, such as a hand. A fluid medium is disposed on the pad. The user presses a hand onto the surface of the fluid retaining medium pad to form a thin layer of fluid medium on the surface of the hand and then presses the hand against a second object to transfer an image of the hand to the second article.

1 Claim, 2 Drawing Sheets

HAND SHAPED FLUID MEDIUM CONTAINING ARTICLE FOR USE IN TRANSFERRING IMAGES

BACKGROUND OF THE INVENTION

Rectangular ink pads are well known. Such pads are used in every day life and in business operations. Incoming mail is often stamped with the date of receipt. Other documents are stamped with information concerning distribution, confidentiality, and other important information for the reader. Typically, the ink pad used in such stamping activities has sufficient surface area so that the stamp contacts a certain area of the ink pad and is pressed into the pad so that a thin layer of ink covers the surface of the stamp. The stamp with layer of ink is then pressed onto a second surface (e.g., paper) to be imprinted.

Fingerprints are also obtained with the use of a conventional rectangular ink pad. For such prints, each finger is typically pressed onto the ink pad and rolled back and forth over the surface of the pad so that a thin layer of ink forms on the surface of the finger. The finger with ink layer is then pressed gently against a piece of paper, cardboard, or the like and again rolled back and forth without smudging to create an inked impression of the finger surface on the paper.

Children of all ages love to get their fingers and hands dirty. Finger painting is a particularly fun activity. Children also tend leave their "mark" by placing their dirty hands on clean surfaces such as walls, furniture, and the like. Character stamps have also become very popular recently wherein impressions of cartoon characters are etched or grooved onto rubber surfaces of stamping blocks. A stamp is pressed onto an ink pad so as to form a layer of ink on the surface of the rubber stamp. The stamp is then pressed onto paper, cardboard, or another surface to transfer the character image of the stamp onto the surface. The ink pads used in stamping are generally rectangular in shape and may have a variety of areas within the rectangle of different color inks so that colorful images can be created.

Children also love sending letters to and preparing drawings for loved ones. Often, the child is too young to be able to write his name on the letter or picture. Occasionally, the child sticks his/her hands in finger paint or other non-toxic washable paint to form a layer of the paint on the hand and then press their hands onto a picture to leave an impression as their signature. This is often a messy operation that requires additional trays, paint containers and the like to hold the paint and have sufficient area for the child to lay their hand on and form the layer of paint. The ink pads described above, in general, do not have sufficient area for the disposition of a child's hand. Moreover, the conventional rectangular ink pad did not reflect the shape of the child's hand thereby causing confusion to the child.

Although a niche of children's ink pads has developed wherein ink pads are child safe and inks used within the pads are washable and non-toxic, heretofore, fanciful ink pads having a particular shape have not been developed. There is a need for a fluid medium containing article to be provided in the shape of a person's extremity such as a hand having a palm region and finger regions so that children may fit their hands onto the pad so that a thin layer of transfer fluid remains on their hand which can then be pressed onto a surface to create an impression of the child's hand.

BRIEF SUMMARY OF THE INVENTION

In a first aspect, the present invention is directed to a fluid medium containing article for use in transferring an image onto a second article. The fluid medium containing article includes a base and a fluid medium retaining pad positioned on the base. The fluid medium retaining pad is generally in the shape of a terminal portion of a human extremity. A fluid medium is disposed on the pad.

In a second aspect, the present invention is directed to a fluid medium containing article for use in transferring an image onto a second article wherein the fluid medium containing article includes a base and a fluid medium containing pad positioned on the base. The pad is generally in the shape of first and second terminal portions of two human extremities in juxtaposed position. A fluid medium is disposed on the pad.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purposes of illustrating the invention, there are shown in the drawings, embodiments which are presently preferred. It should be understood, however, that the invention is not limited to the precise arrangements and instrumentalities shown. In the drawings.

DETAILED DESCRIPTION OF THE INVENTION

Figure 1:
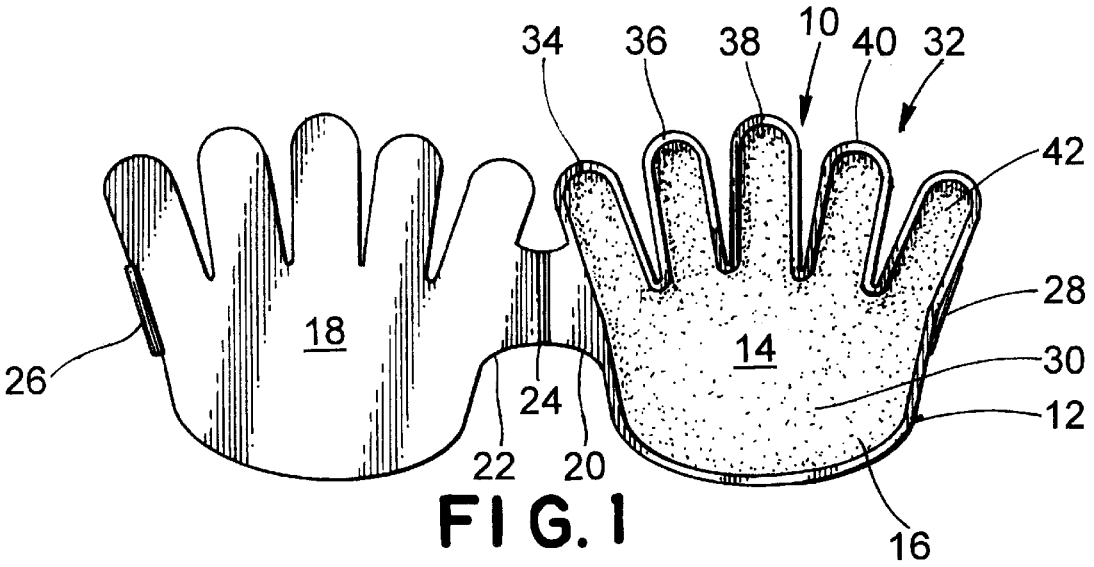
FIG. 1 is a top plan view of the fluid medium containing article according to a first embodiment of the present invention.
Figure 2:
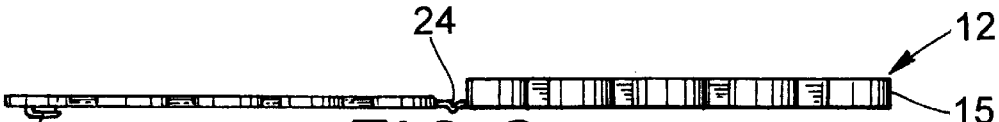
FIG. 2 is a front elevational view of the fluid medium containing article shown in FIG. 1.
Figure 3:
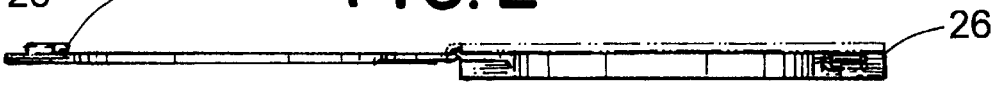
FIG. 3 is a rear elevational view of the fluid medium containing article shown in FIG. 1 with the article in a closed position shown in phantom.

Certain terminology is used in the following description for convenience only and is not limiting. The words "lower," "upper," "left," and "right" designate directions in the drawings to which reference is made. The terminology includes the words above specifically mentioned, derivatives thereof and words of similar import.

The following disclosure describes the construction and use of a fluid medium containing article for use in transferring an image to a second article. The article, including the fluid medium retaining pad, is generally in the shape of a terminal portion of a human limb or extremity. The article is described by way of example in terms of a preferred embodiment, (i.e., in the shape of a person's hand). However, it is intended that the invention not be limited to a hand and that a foot shaped article could also be made and used without deviating from the spirit and scope of the invention.

Figure 4:
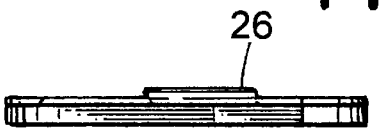
FIG. 4 is a left side elevational view of the fluid medium containing article shown in FIG. 1.
Figure 5:
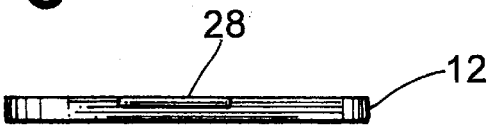
FIG. 5 is a right side elevational view of the fluid medium containing article shown in FIG. 1.
Figure 6:
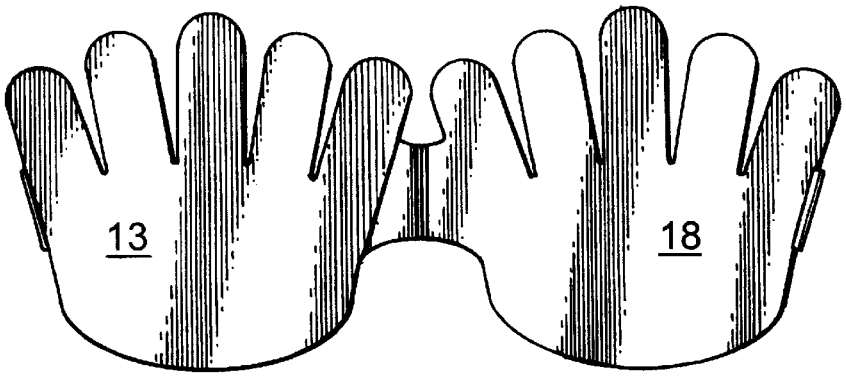
FIG. 6 is a bottom plan view of the fluid medium containing article shown in FIG. 1.

Referring now to the drawings in detail, wherein like numerals are used to indicate like elements throughout, there is shown in FIGS. 1–6, a preferred embodiment of the fluid medium containing article, generally designated 10, for use in transferring an image to a second article in accordance with the present invention. The fluid medium containing article 10 has a base 12. The base 12 may have any general geometric shape so long as there is sufficient area for the disposition of a fluid medium retaining pad 14. Preferably, and as shown in FIGS. 1 and 6, the base 12 has the general shape of a human extremity, such as a hand. Generally, the fluid medium containing article 10 is shaped generically or bilaterally so that either a right or left hand could fit within the base 12. As such, the fingers of the base are spaced generally equally apart rather than providing a generally larger space between the thumb and index finger as is the case for the typical human hand. It is understood by those of ordinary skill in the art that the present invention is not limited to the base 12 being of any particular shape, and that other shapes such as, but not limited to, a square, circle, -and the like could be used without departing from the spirit and scope of the invention so long as the base 12 has sufficient area to retain the other elements necessary in the construction of the fluid medium containing article 10. In addition, as mentioned above, it is understood by those of ordinary skill in the art that the present invention is not limited to the base 12 having a general shape of a hand and that the base could depict the general shape of a foot (not shown) without departing from the spirit and scope of the invention.

The base 12 is preferably made of a relatively strong, durable material having sidewalls 15 extending upwardly from a bottom wall 13 forming a well thereby enabling the base 12 to support the fluid medium retaining pad 14 and medium 16. It is understood by those of ordinary skill in the art that the materials used in the construction of the base 12 is not limited to any particular material, and that materials such as plastics, metal, wood, or the like could be used as the base without departing from the spirit and scope of the invention.

A fluid medium retaining pad 14 is positioned within the sidewalls 15 and bottom wall 13 of the base 12. The fluid medium retaining pad 14 has a shape matching that of base 12 and generally conforming to that of a terminal portion of a human extremity. Referring to FIG. 1, the fluid medium retaining pad 14 preferably has a shape generally conforming to that of a person's hand.

In general, the fluid medium containing pad 14 is generically or bilaterally shaped to receive one of a left hand or a right hand. The fluid medium retaining pad 14, as shown in FIG. 1, includes a palm region 30 and a finger region 32. The finger region 32 includes a plurality of fingers including (from left to right) thumb 34, index finger 36, middle finger 38, ring finger 40, and pinky 42. It is understood by those of ordinary skill in the art that the present invention is not limited to a finger region 32 having individual fingers shown. Instead, the finger region 32 could be generally mitten-shaped (not shown) wherein the palm, thumb, and clustered fingers are shown, without departing from the spirit and scope of the invention.

The fluid medium retaining pad 14 is made of the same materials as used in conventional ink pads such as a sponge covered with felt, porous open-celled rubber or other porous flexible materials such as, but not limited to sponges or latex foam. It is understood by those of ordinary skill in the art that the present invention is not limited to constructing the fluid medium retaining pad 14 of any particular material and that other materials could be used without departing from the spirit and scope of the invention.

The thickness of the pad 14 should be sufficient so that a small child can press their hand or fingers or palm onto the pad 14 without the pad 14 being substantially deformed or compressed such that the medium oozes to the surface. In general, the thickness of the pad ranges from 0.25 inches to 0.5 inches. In addition, the thickness of the pad 14 may vary across the area of the pad 14. For example, where the fluid medium retaining pad 14 is in the shape of a hand, the tips of the thumb and individual fingers (34, 36, 38, 40, 42) may be slightly depressed so that the thickness of the pad 14 in these areas is less that of other areas of the pad 14. Likewise, and optionally in conjunction with the finger regions as described above, select regions of the palm 30 may be depressed so that the thickness of the pad 14 in these areas is less than that of other areas of the pad 14. It is understood by those of ordinary skill in the art that the present invention is not limited to the pad 14 being of any particular thickness and that the pad may be of other thicknesses without departing from the spirit and scope of the invention.

A fluid medium 16 is disposed on or incorporated into the pad 14. Such fluid media 16 include ink, paint, paste, powder, ground chalk, and colored hydrous liquid. The fluid medium 16 may be white, black or any other primary or secondary color. Alternatively, several colors of fluid media 16 may be disposed within the pad 14 at select areas so that a multi-color effect is created. However, it is understood by those of ordinary skill in the art, that the present invention is not limited to the fluid medium 16 being of any particular material and that other materials could be used without departing from the spirit and scope of the invention so long as the media used for children is safe and nontoxic. Preferable materials also include those which are water-based or washable.

Referring again to FIG. 1, a lid 18 is provided for disposition over the base 12 and the pad 14. As shown in FIG. 1, the lid 18 is hingedly affixed to the base 12 by a pair of first and second hinge leaves 20, 22 whereby the lid 18 covers the pad 14 in a closed position (shown in phantom in FIG. 3). Referring to FIGS. 1 and 6, the first hinge leaf 20 extends from the left finger (thumb) 34 of base 12 and cooperates with the second leaf 22 extending from the right finger of lid 18 via a living hinge 24 disposed between the first and second leaves 20, 22. In the closed position, the lid 18 is rotated about the longitudinal axis of hinge 24 so that the lid 18 mates with the base 12 and encloses the fluid medium retaining pad 14 in a sealed manner thereby preventing the fluid medium 16 from leaking or evaporating. It is understood by those of ordinary skill in the art that the present invention is not limited to a hinged lid and that other suitable lids, such as a separate and unattached lid or covering (not shown) could be used without departing from the spirit and scope of the invention. It is also understood by those of ordinary skill in the art that the location of the hinge 24 with first and second leaves 20, 22 may vary from that shown in FIGS. 1 and 6 and that other locations of the hinge 24 and leaves 20, 22 on the base 12 and lid 18 are also suitable without departing from the spirit and scope of the invention.

Referring to FIGS. 4 and 5, cooperative elements of a locking clasp including a first element 26 in the shape of a clasp, located on the lid 18, cooperates with a second element 28, an indentation, located on the base 12 of the fluid medium containing article 10. In a closed or locking position, the first element 26 is secured within second element 28 by an interference fit. It is to be understood by those of ordinary skill in the art that the present invention is not limited to construction of a clasp mechanism and that other suitable locking mechanisms such as a snap fit (not shown) could be used without departing from the spirit and scope of the invention.

The size of the fluid medium containing article 10 is generally sufficiently large so that an older child could lay their entire hand over the fluid medium retaining pad 14 with the user's fingers being disposed within the finger portion 32 of the pad 14 and the palm region of the user's hand being disposed within the palm region 30 of the pad 14. Alternatively, a younger child or infant could lay their entire hand solely within the palm region 30 of the pad 14.

In use, by pressing one's hand on the surface of the fluid retaining medium pad 14, a thin layer of fluid medium forms on the surface of the hand. Depending on the size of the hand it will either fit entirely within the palm region 30 as the fingers will extend into the finger region 32. The hand or fingers with fluid layer may be then pressed against a second article (not shown) such as a piece of paper, holiday, or special event greeting card or other object, so that an image of the hand or a portion of the hand is transferred to the second article. The fluid medium containing article 10 is shaped generically or bilaterally so that either a right or left hand could be used with the article 10. The article 10 may be used repeatedly until the fluid medium 16 needs to be replaced or refilled.

Referring now to FIGS. 7 through 12, there is shown a fluid medium containing article 110 in accordance with a second embodiment of the invention. The article 110 of the second embodiment is similar to article 10 of the first embodiment, and like elements have been identified with the same reference numbers except the prefix "1" has been added. For example, the base 112 of the article 110 of the second embodiment is similar to the base 12 of the article 10 of the first embodiment. The base 112 is provided with sidewalls 115 extending upwardly from a bottom wall 113 forming a well thereby enabling the base 112 to support a fluid medium retaining pad 114.

The base 112 is divided by an axis 154 extending generally perpendicular to the longitudinal axis 156 of the base 112, into two base sections including a right section 109 and a left section 118. Both of the base sections 109 and 118 are shown to have the general shape of first and second terminal portions of two human extremities in juxtaposed position, namely that of two hands. Although the general shape of the two base sections 109 and 118 is sufficiently large so that either a user's right or left hand can fit within either base section 109 or 118, the general shapes of the two hands facilitate the user to put their right hand in base section 109 and their left hand in base section 118. It is understood by those of ordinary skill in the art that the present invention is not limited to the base 112 being of any particular shape and that other geometric shapes including but not limited to circles, rectangles and the like or other human extremities (e.g., feet) may be depicted without departing from the spirit and scope of the invention.

Figure 7:
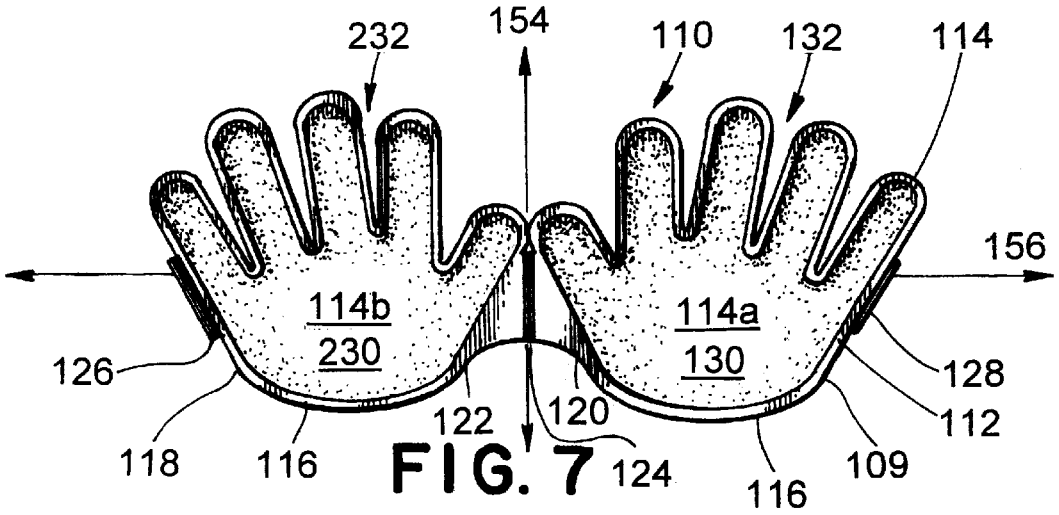
FIG. 7 is a top plan view of a fluid medium containing article according to a second embodiment of the present invention.
Figure 8:
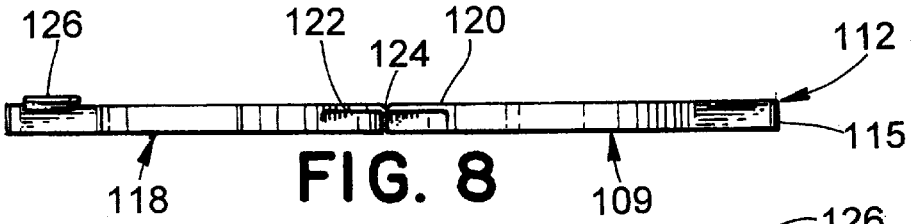
FIG. 8 is a rear elevational view of the fluid medium containing article shown in FIG. 7.
Figure 9:
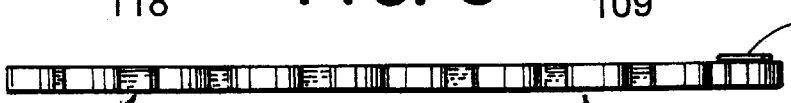
FIG. 9 is a front elevational view of the fluid medium containing article shown in FIG. 7.
Figure 10:
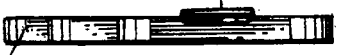
FIG. 10 is a left side elevational view of the fluid medium containing article shown in FIG. 7.
Figure 11:
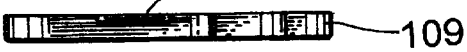
FIG. 11 is a right side elevational view of the fluid medium containing article shown in FIG. 7.
Figure 12:
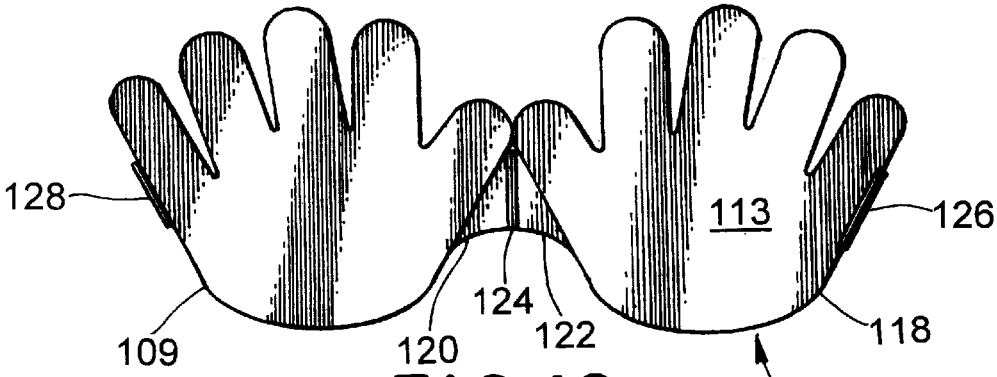
FIG. 12 is a bottom plan view of the fluid medium containing article shown in FIG. 7.

Referring to FIG. 7, a fluid medium retaining pad 114 is positioned within the base 112. The fluid medium retaining pad 114 corresponds to shape of base 112 and as such is divided generally into two equally sized pads depicting first and second terminal portions of two human extremities in juxtaposed position. As shown in FIG. 7, a right hand pad 114*a* and left hand pad 114*b* are depicted. It is understood by those of ordinary skill in the art that the present invention is not limited to the pad 114 being in the shape of two hands in juxtaposed position and that other extremities including feet could also be depicted.

A fluid medium 116 is disposed within pad 114. The fluid retaining pad 114 is comprised of the same materials as the fluid retaining pad 14 described with respect to the first embodiment. The media 116 used within the fluid retaining pad 114 include those identified as suitable for use with respect to the first embodiment.

Referring again to FIG. 7, the right section 109 is hingedly affixed to the left section 118 of base 109 in a manner similar to that described above with respect to base 12 and lid 18 of the first embodiment. As such, a first leaf 120 extends from the left most finger (thumb) of right base section 109 and a second leaf 122 extends from the right most finger (thumb) of left base section 118. The two leaves 120, 122 are then hingedly affixed to each other by the living hinge 124.

In an open position, left section 118 is juxtaposed to right section 109 so that the fluid medium retaining pad sections 114*a*, 114*b* are both exposed. Again, similar to the general hand shape described with respect to the first embodiment, the preferred second embodiment in an open position shows two hands including the right base section 109 corresponding to the shape a right hand and the left base section 118 corresponding to a left hand. Each of the base sections 109, 118 include palm regions 130, 230, and finger regions 132, 232. In addition, each finger region 132, 232 includes the general five fingers associated with a hand including a left thumb 234 and a right thumb 134. Alternatively, but not shown, the base of each section 109, 118 may include a palm, thumb, and four clustered fingers to reflect a mitten-type shape. The pads 114*a*, 114*b* are generally of a thickness so as to fit within the bases 109, 118 and are similar to those described above.

In a closed position, the left section 118 is rotated about axis 154 and hinge 124 so that the pads 114*a*, 114*b* face each other. A clasp, including element 126 similar to that described with respect to the first embodiment, engages with indented portion 128 to ensure closure of the article 110. Other locking mechanisms similar to those described above with respect to the first embodiment are also suitable.

In use, a child or adult presses each of their hands into either the right 109 or left 118 section of the pads 114*a*, 114*b*, respectively. Preferably, the user places their right hand into the right section 109 and their left hand into the left section 118. A thin layer of fluid medium thus forms on the surface of each hand. The hands or fingers with fluid layer are then pressed against a second article (not shown) such as a piece of paper, greeting card, or other object so that images of the hands are transferred to the second article.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A fluid medium containing article for use in transferring an image onto a second article, said fluid medium containing article comprising:

a base;

a fluid medium retaining pad positioned on said base, said pad being generally in the shape of first and second terminal portions of two human extremities in juxtaposed position the first terminal portion being positioned on a first section of said base and the second terminal portion being positioned on a second section of said base, said first and second section of said base being hingedly connected together; and a fluid medium disposed on said pad.

* * * * *